US009567812B2

(12) United States Patent
Sallwasser et al.

(10) Patent No.: US 9,567,812 B2
(45) **Date of Patent: *Feb. 14, 2017**

(54) DOWNHOLE TOOL IMPACT DISSIPATING TOOL

(71) Applicant: Schlumberger Technology Corporation, Sugar Land, TX (US)

(72) Inventors: Alan J. Sallwasser, Houston, TX (US); Bulent Finci, Sugar Land, TX (US); Jaime Pedraza, Cypress, TX (US); Akio Kita, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 263 days.

This patent is subject to a terminal disclaimer.

(21) Appl. No.: 14/333,673

(22) Filed: Jul. 17, 2014

(65) Prior Publication Data

US 2014/0326513 A1 Nov. 6, 2014

Related U.S. Application Data

(63) Continuation of application No. 13/276,076, filed on Oct. 18, 2011, now Pat. No. 8,813,876.

(51) Int. Cl.
*E21B 17/07* (2006.01)

(52) U.S. Cl.
CPC ..... *E21B 17/07* (2013.01)

(58) Field of Classification Search
CPC ..... E21B 17/10; E21B 17/1042
See application file for complete search history.

(56) References Cited

U.S. PATENT DOCUMENTS

| | | | | |
|---|---|---|---|---|
| 3,511,345 | A | 5/1970 | Takamatsu et al. | |
| 4,552,230 | A * | 11/1985 | Anderson | E21B 17/07 175/321 |
| 5,117,911 | A | 6/1992 | Navarette et al. | |
| 6,454,012 | B1 | 9/2002 | Reid | |
| 8,813,876 | B2 * | 8/2014 | Sallwasser | E21B 17/07 175/262 |
| 2009/0242206 | A1 * | 10/2009 | Goughnour | E21B 34/06 166/332.8 |

* cited by examiner

*Primary Examiner* — William P Neuder
(74) *Attorney, Agent, or Firm* — Fletcher Yoder, P.C.

(57) ABSTRACT

An impact dissipation tool for supporting a downhole tool in downhole applications. The tool includes a base and a housing. The tool also includes a carriage located within the housing and coupled to the base, the carriage being movable relative to the housing upon a predetermined impact force. A dissipator disposed inside the housing is collapsible due to the relative movement of the carriage and the housing. The collapse of the dissipator dissipates the impact force transferred to the downhole tool.

18 Claims, 6 Drawing Sheets

DOWNHOLE TOOL IMPACT DISSIPATING TOOL

CROSS-REFERENCE TO RELATED APPLICATIONS

This application is a continuation of U.S. application Ser. No. 13/276,076, filed Oct. 18, 2011, which is incorporated herein by reference in its entirety.

BACKGROUND

In hydrocarbon drilling operations, downhole tools may be lowered into the borehole either to perform specific tasks. For example, a logging string system may be lowered through a drill string or downhole tubular. The logging string system includes a logging tool that takes various measurements, which may range from common measurements such as pressure or temperature to advanced measurements such as rock properties, fracture analysis, fluid properties in the wellbore, or formation properties extending into the rock formation. In some cases, the logging tool is suspended on a shoulder inside the drill string; that is, the logging tool may extend below the drill bit, and into the well bore formations.

In certain cases, the downhole tool impacts a shoulder inside the drill string or with ledges of rock formations at high velocity, resulting in damage or loss of the downhole tool. While the tool and line may have devices capable of absorbing a portion of the impact, these absorbers absorb energy through elastic deformation of an element and are typically always free to operate. They are thus only used to protect the components of the downhole tool from unnecessary vibrations and are multi-use due to the elastic nature of the absorption. These elastic shock absorbers are not meant to act as a one-time use dissipator that can absorb a high load impact that might cause a portion of the tool to break off or separate.

BRIEF DESCRIPTION OF THE DRAWINGS

For a more detailed description of the embodiments, reference will now be made to the following accompanying drawings.

DETAILED DESCRIPTION

Figure 1:
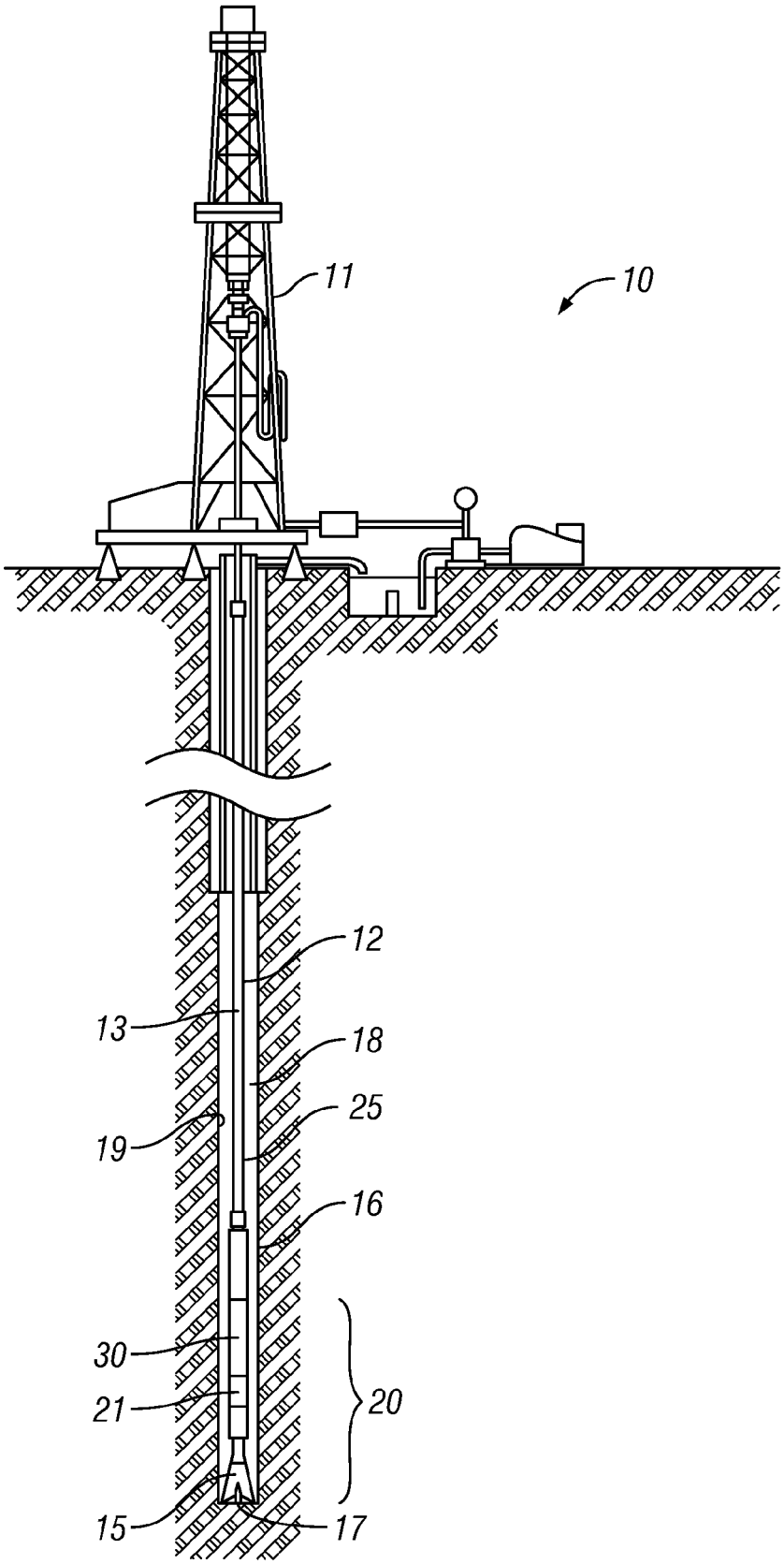
FIG. 1 shows a schematic view of an embodiment of a drilling system in accordance with various embodiments.

In the drawings and description that follows, like parts are marked throughout the specification and drawings with the same reference numerals. The drawing figures are not necessarily to scale. Certain features of the invention may be shown exaggerated in scale or in somewhat schematic form and some details of conventional elements may not be shown in the interest of clarity and conciseness. The invention is subject to embodiments of different forms. Some specific embodiments are described in detail and are shown in the drawings, with the understanding that the disclosure is to be considered an exemplification of the principles of the invention, and is not intended to limit the invention to the illustrated and described embodiments. The different teachings of the embodiments discussed below may be employed separately or in any suitable combination to produce desired results. The terms "connect," "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring now to FIG. 1, an example downhole drilling system 10 comprises a rig 11, a drill string 12, and a Bottom Hole Assembly (BHA) 20 including drill collars 30, stabilizers 21, and the drill bit 15. With force or weight applied to the drill bit 15 via the drill string 12, the rotating drill bit 15 engages the earthen formation and proceeds to form a borehole 16 along a predetermined path toward a target zone in the formation. The drilling fluid or mud pumped down the drill string 12 passes out of the drill bit 15 through nozzles positioned in the bit. The drilling fluid cools the bit 15 and flushes cuttings away from the face of bit 15. The drilling fluid and cuttings are forced from the bottom 17 of the borehole 16 to the surface through an annulus 18 formed between the drill string 12 and the borehole sidewall 19. Interior profiles 25 may be positioned in any tubular in the borehole 16 or in the borehole sidewall 19.

Figure 2:
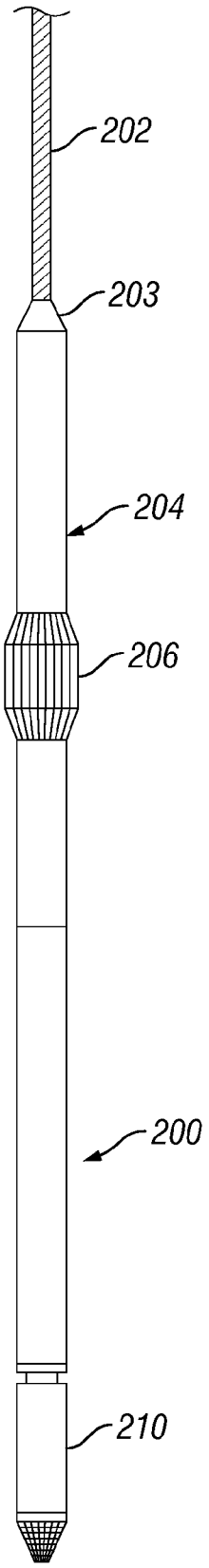
FIG. 2 shows an impact dissipating tool in accordance with various embodiments.

Referring now to FIG. 2, an example of a tool 200 in accordance with various embodiments is shown. The tool 200 is lowered into and suspended in the wellbore inside the drill string 12 or another tubular member by a suspension element 202 (e.g., a wireline or slickline). As an example, a wireline cable winch at the surface may be used to lower and suspend the tool 200. Other lowering mechanisms could include a crane. In addition to being gravity-fed, the tool 200 may also be conveyed into position by pumping the tool 200 into position or any other suitable method. The suspension element 202 and tool 200 are optionally configured to pass into borehole 16 beyond the drill bit 15, for instance when a portion of the drill bit 15 is opened to allow passage of the tool 200 through the bit 15.

The tool 200 is configured to connect a base 204, such as drop-off tool, and line tool 210. The base 204 may be any type but as shown comprises a drop-off tool with a cable head 203 connected with suspension element 202. The drop-off tool also comprises a landing member 206 that contacts interior profiles 25 of drill string 12, borehole sidewall 19, or other tubulars used in drilling operations (i.e. casing tubulars). Interior profiles 25 may be joints, cut-outs, ledges, diameter changes, earthen formations, or tubular inserts, for example a landing ring. Optionally, drop-off tool 204 further comprises a release, sensors (e.g., proximity sensors, linear variable differential transformers, limit switches), communications, and a fishing neck (not shown).

Line tool 210 comprises any tool configured for deploying into a borehole 16. Line tool 210 may be any configured to pass through the tubulars of drill string 12 or casing (not shown). As described herein, line tool 210 may be configured to pass through drill string 12 and drill bit 15 into well bore 16. Optionally, line tool 210 comprises sensors for logging data. Line tool 210 may have sensors for logging measurements such as pressure or temperature as well as measurements such as rock properties, fracture analysis, fluid properties in the wellbore, or formation properties extending into the rock formation.

Figure 3A:
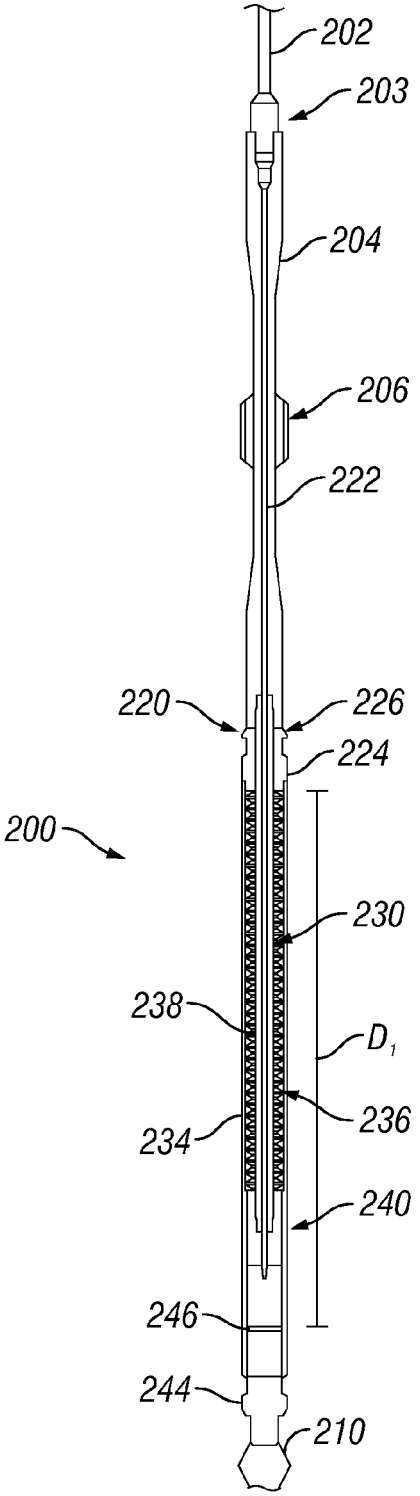
FIG. 3A shows an impact dissipating tool in accordance with various embodiments.

Referring now to FIG. 3A, an example of a tool 200 in accordance with various embodiments is illustrated. Tool 200 includes an outer housing 234 extending between a cap 220 and end 244, although the cap 220 and the end 244 do not need to be separate from the housing 234 as shown. Cap 220 couples tool 200 to the drop-off tool 204 and the suspension member 202. End 244 couples the tool 200 to the line tool 210 or other downhole tools. Line tool 210 is disposed below end 244. The tool 200 further comprises a dissipator 238 extending within the outer housing 234 between cap 220 and end 244.

Extending through the cap 220 and into the outer housing 234 is an internal line 222. In accordance with certain embodiments, the internal line 222 extends between the cap 220 and a carriage 240. Alternatively, internal line 222 may extend longitudinally from cable head 203, through drop-off tool 204, and couple with the carriage 240. The cap 220 surrounds and can move relative to the internal line 222.

According to various embodiments, the end 244 is coupled to and supports line tool 210. The carriage 240 is optionally coupled to the end 244 by a coupler 246. The coupler 246 is not necessary though because the dissipator 238 may be designed support the hold the housing 234 in place relative to the base 204 during normal use. If coupler 246 is used, the coupler 246 is configured to decouple, release, or fail when a predetermined force is applied or transmitted therethough. Coupler 246 may be configured as a shear-bolt or hold-back bolt with a predetermined failure rating or shear rating. Without limitation, the housing 234 is configured to move away from the base 204 when the coupler 246 releases the carriage 240 from the end 244.

In various embodiments, the cap 224, the outer housing 234, and carriage 240 form a volume 236 in the tool 200. The volume 236 is disposed annularly about internal line 222. Volume 236 has a longitudinal axis having a length $D_1$ that is measured from the carriage 240 to the cap 224.

According to various embodiments, the dissipator 238 and the carriage 240 are disposed in the volume 236, with the dissipator 238 located between the carriage 240 and the cap 224. Further, the dissipator 238 may be annular to the internal line 222 and outer housing 234.

As may be understood by an ordinarily skilled artisan, length $D_1$ compresses to length $D_2$ after impact. Additionally, as the cap 224 moves longitudinally along internal line 222, the volume 236 decreases. Without limitation by any theory, the volume 236 decreases as the volume longitudinal axis length D decreases, such that length $D_1$ is greater than the length $D_2$, resultant from an impact for example.

Figure 3B:
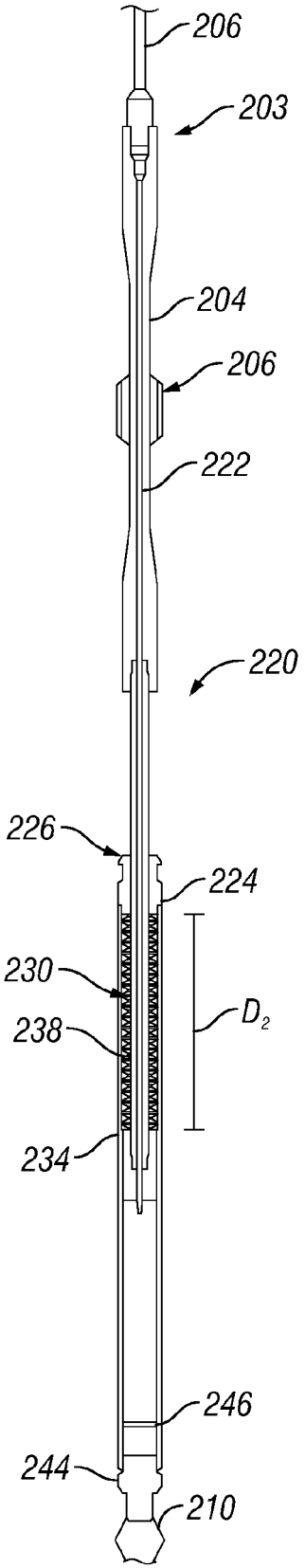
FIG. 3B shows an impact dissipating tool in accordance with various embodiments.
Figure 4:
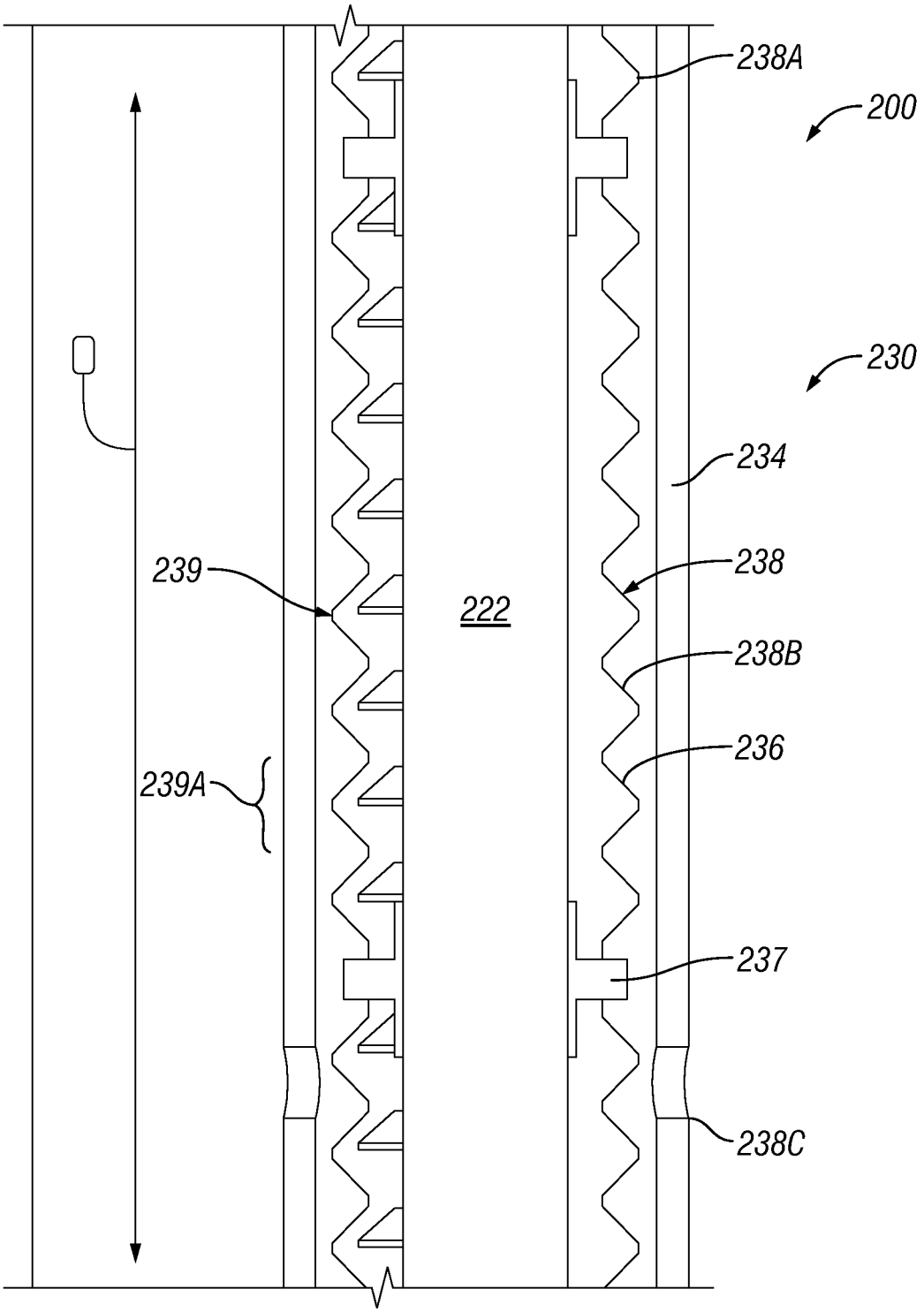
FIG. 4 shows an expanded view of a portion of an impact dissipating tool in accordance with various embodiments.

Referring now to FIGS. 3B and 4, according to various embodiments, dissipator 238 is configured to collapse as the housing 234, and thus the cap 224 moves relative to internal line 22 away from the drop-off tool 204. Dissipator 238 may be any structure or material that plastically deforms in response to an applied force or load. Non-limiting materials include metals and alloys thereof; polymers, plastics, and composites thereof; and combinations thereof. The dissipator 238 may also include sections or mixes of different materials. In certain aspects, due to the conditions (i.e. temperature, pressure) in a drill string 12 and well bore 16, it may be preferable that the dissipator 238 comprises metal or metal alloy compositions. The composition of the dissipator 238 may determine the properties (i.e. rate, resistance) of dissipator 238 collapse. The composition of the dissipator 238 may be chosen based on the line tool 210 dimensions and properties, such as weight.

The dissipator 238 may also be configured as different structures, such as bellows as shown in FIG. 4. The radial, angular, and longitudinal (i.e. measured along internal line 222) dimensions of features 238A of bellows may increase and decrease in a regular, repeating fashion. Alternatively, the radial, angular, and longitudinal dimensions of features 238A may be variable throughout dissipator 238. The dimensions of features 238A may determine the properties (i.e. rate, resistance) of dissipator 238 collapse. The dimensions of features 238A may be chosen based on the line tool 210 dimensions and properties, such as weight.

In accordance with various embodiments, a collar 237 may be disposed annular to the internal line 222. Collar 237 is configured to move relative to the internal line 222. Collar 237 may be used to position and align a plurality of dissipator segments or individual dissipators 238A, 238B, 238C in the volume 236 of tool 200. Additionally, collar 237 may allow replacement of a portion of the dissipator 238. For example the replacement of one dissipator 238A, without replacing additional dissipators 238B, 238C without limitation. Collar 237 comprises a non-compressible material, for example a metal, composite, or combination thereof. Collar 237 may be made of any material suitable for use in dissipator 238. As may further be understood by an ordinarily skilled artisan, features 238A of bellows 238 in each dissipator 238A, 238B, 238C, may be variable such that the properties (i.e. rate, resistance) of each dissipator 238A, 238B, 238C are tunable to a particular application (i.e. tool, borehole, drill string, etc.).

In accordance with various embodiments, illustrated in FIGS. 1-4 and described herein, the tool 200 is configured to dissipate a high impact force. Generally, the line tool 210 and tool 200 are configured to pass through interior 13 of drill string 12, well bore 16, or casing tubulars. Landing member 206 of the drop-off tool 204 engages the interior profiles 25. Subsequently, drop-off tool 204 supports weight of tool 200 and line tool 210, independently from cable 202.

During line tool 210 lowering operations, due to operator error, inner profiles 25, drill string 12 damage, or debris, landing member 206 may contact a portion of interior 13. The contact may stop the lowering operation, and in certain instances, the contact may result in a high velocity impact. The impact of the landing member 206 on the interior profile 25 or other features of the interior 13 of drill string 12 results in a deceleration force. The line tool 210 may experience a deceleration force sufficient to render the line tool 210 inoperable or worse, the line tool 210 may break free of the cable 202 or disintegrate.

In certain instances, the deceleration force of a high velocity impact may exert a force of greater than 10 times the line tool 210 static weight; alternatively, a force 50 times the line tool 210 static weight; and in certain instances, a force 100 times the line tool 210 static weight. Further, a high velocity impact may be any impact that exerts a deceleration force that exceeds about 10 G (gravities); alternatively, any impact that about exceeds 50 G, and in certain situations exceeds about 100 G.

In accordance with various embodiments, the tool 200 dissipates the impact to reduce the deceleration force transferred to the tool 200. When the deceleration force exceeds the predetermined rating for the coupler 246, the coupler 246 decouples (i.e. fail, shear, release). Decoupling the coupler 246 releases the cap 224, end 244, outer housing 234, and line tool 210 to move independently of drop-off tool 204. The load of these components transferred to the tool 200 comprises a portion of the linear velocity of the lowering operation. The load is transferred to the dissipator 238 such that the dissipator 238 plastically deforms to dissipate the impact. In various embodiments shown herein, the dissipator 238 collapses to dissipate the deceleration force generated by the impact. For example, referring to FIG. 3A and FIG. 3B, the dissipator 238 collapses as the longitudinal distance $D_1$ changes or shortens during and after impact to longitudinal distance $D_2$.

In accordance with various embodiments, the dissipator 238 is configured to absorb a portion of the force from the high velocity impact in order to lower the deceleration force transferred to the line tool 210. In certain instances, the tool 200 reduces the deceleration force of a high velocity impact to less than about 10 times the line tool 210 static weight; alternatively, less than about a force 20 times the line tool 210 static weight; and in certain instances, less than about a force 50 times the line tool 210 static weight. Further, the tool 200 reduces a high velocity impact such that the deceleration force is less than about 100 G (gravities); alternatively, less than about 75 G, and in certain embodiments less than about 50 G.

In accordance with various alternate embodiments, the dissipator 238 may have configurations other than bellows. Any structure configurable for plastic deformation and energy dissipation may be positioned in the dissipator 238. Non-limiting examples include collapsible washer stacks, collapsible cylinders, buck-tail cylinders, mandrel-cylinders, multicellular composite stacks, and combinations thereof.

Figure 5A:
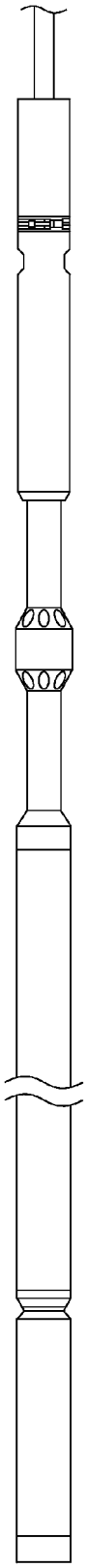
FIG. 5A shows an shows an impact dissipating tool in accordance with various embodiments.
Figure 5B:
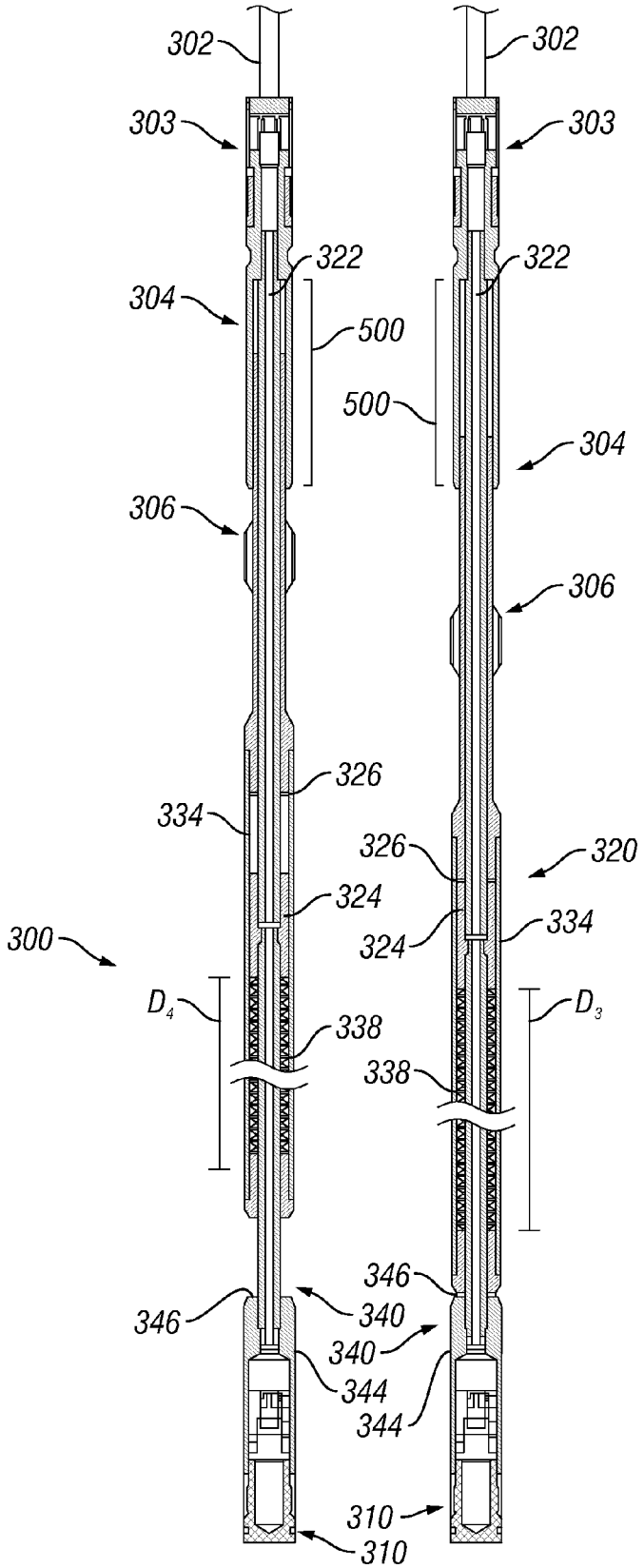
FIG. 5B shows an impact dissipating tool in accordance with various embodiments.

In accordance with various alternate embodiments, and referring now to FIGS. 5A and 5B, an alternative tool 300 is shown. Here, the base 304, also shown for example as a drop-off tool, includes a collapsible portion 500 that includes a landing member sleeve 306 telescopically received within base 304. In this embodiment, an outer housing 334 is coupled to the landing member sleeve 306 and extends to an end 346. Inside the volume 336 created by the outer housing 334 and the end 346 is a dissipator 338 as well as a carriage 324. Inside the volume 336 is an internal line 322 connecting the carriage 324 to the drop-off tool 304 such that the carriage 324 is maintained a fix distance away from the drop-off tool 304. Volume 336 has a longitudinal axis having a length $D_3$ that is measured from the carriage 324 to the end 346 prior to collapse. Carriage 324 is also coupled to a support 344 by internal line 332, with the line tool 310 attached to the support 344.

The internal lines 322, 332 maintain the drop-off tool 304, the carriage 324, and the support 344 and line tool 310 at fixed distances both before and after collapse of the dissipator 338.

Before collapse, the landing member sleeve 306, the outer housing 334, and the end 346 are optionally coupled to the support 344 directly or indirectly by a coupler configured to decouple, release, or fail when a predetermined force is applied or transmitted therethough. The coupling is such that the landing member sleeve 306, the outer housing 334, and the end 346 do not move relative to any other parts of the tool 300. The coupler is not necessary though because the dissipator 338 may be designed to support the outer housing 334 and the end 346.

As mentioned above, the coupler may be configured as a shear-bolt or hold-back bolt with a predetermined failure rating or shear rating. As such, during an impact of sufficient force, the force on the landing member sleeve 306 transfers to the coupler to shear the coupler. Shearing the coupler allows the drop-off tool 304, the internal lines 322, 332, the carriage 324, the support 344, and the line tool 310 to move relative to the landing ring sleeve 306, the outer housing 334, and the end 346. This movement decreases the volume 336 such that, after impact, the volume 336 has a longitudinal axis having a length $D_4$ because the carriage 324 moves closer to the end 346, collapsing the dissipator 338 to dissipate the impact forces as described above.

Further, as illustrated the alternate embodiments of present disclosure shown in FIGS. 3A and 3B and FIGS. 5A and 5B may be considered inverted impact dissipators relative to one another. Without limitation, an inverted configuration may refer to the position of the moveable elements of the impact dissipator, for example the movement of the external housing (i.e. 234, FIG. 3) or the internal carriage (i.e. 324, FIG. 5), without limitation.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent . . . 95 percent, 96 percent, 97 percent, 98 percent, 99 percent, or 100 percent. Moreover, any numerical range defined by two R numbers as defined in the above is also specifically disclosed. Use of broader terms such as "comprises," "includes," and "having" should be understood to provide support for narrower terms such as "consisting of," "consisting essentially of," and "comprised substantially of." Accordingly, the scope of protection is not limited by the description set out above but is defined by the claims that follow, that scope including all equivalents of the subject matter of the claims. Each and every claim is incorporated as further disclosure into the specification, and the claims are embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural or other details supplementary to the disclosure.

To further illustrate various illustrative embodiments of the present invention, the following examples are provided:

EXAMPLE

The following are non-limiting examples of various embodiments of the disclosure.

Tool String Properties: In some applications the line-tool weight is approximately 500 pounds up to about 750 pounds (lbs.). However, the most frequently used line-tool weight is between about 350 lbs and about 425 lbs.

The peak axial G (Gravity) survivable by wireline tools is usually between about 100 G and about 125 G. In order to maintain an operational "2×" (double) margin of safety an impact dissipation to below 50 G is preferable. However, maximal impact dissipation up to between about 100 G and about 125 G may be incorporated. The preferred peak deceleration forces would be about 25,000 lbs. on a 500 lbs. line-tool or about 17500 lbs. on a 350 lbs. line-tool at 50 G.

Impact Dissipation Properties: The energy absorption requirement is determined by the height of the potential air-drop at the surface or the possible velocity of the line-tool before impact inside a tubular or borehole. For example, an inadvertent air-drop freefall from 50 feet with a 350 pound line-tool requires the dissipation of 17,500 ft-lbs. of potential energy. This 50 foot air drop has an impact velocity of 56.7 feet per second (ft/sec). A line-tool propelled by differential pressure in a downhole situation to similar velocity would have similar energy dissipation requirements.

Comparative Linear-Specific Energy Capacity: Once the line-tool is falling, the means to slow or stop the fall is dependent on the energy capacity or absorption of the stopping means. Energy absorption by friction, for example a brake applied to the inner face of a tubular, is subject to high variability due to varying co-efficients of friction, resulting from unwanted lubrication, viscosity variation with temperature, and friction variation due to storage or corrosion. Friction devices may also be overly sensitive to machine and tubular tolerances. Break-away forces are also subject to large variability in the static friction coefficient.

A coil spring with an outer diameter of ¾ inch, a 1 inch inner diameter, manufactured of ⅜ inch chrome-silicone spring wire having an approximate yield strength of 250,000 pounds per square inch (psi), results in approximately 200 foot-pounds (ft-lbs) per linear foot of energy storage.

A collapsible structure, such as a collapsible bellow with an un-collapsed outer diameter of 1.6", a 1" inner diameter, manufactured of 1018 cold rolled steel having an approximate yield strength=55,000 psi, resulting in approximately 8000 ft-lbs per linear foot of energy dissipation. Additionally, in the collapsible bellow arrangement, the collapsed outer diameter would be 1¾".

Figure 6:
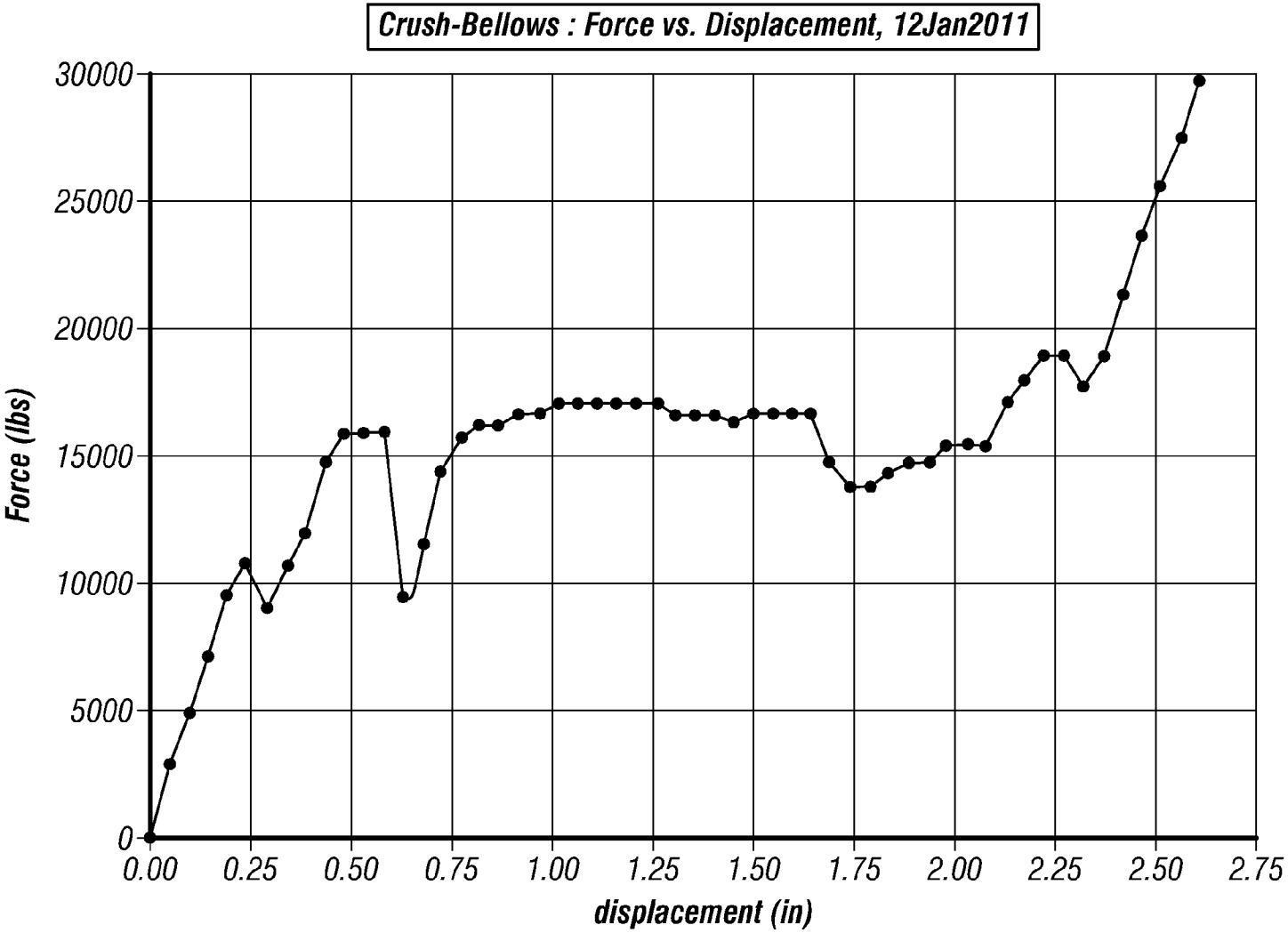
FIG. 6 shows a lab simulation of the impact dissipation of the tool according to various embodiments of the disclosure

Experimental: FIG. 6 illustrates a lab measurement of a prototype bellow section according to various embodiments of the disclosure. Plastic deformation of the bellows begins at about 10,000 pounds of force and a ¼" of deformation. Then there is a span of deformation up to about 2⅜" where force is reasonably constant at 17000 pounds. Energy dissipation is about 2800 ft-lbs. A force of 17000 pounds would represent a deceleration of about 50 g on a tool weight of 350 pounds. A tool of 350 pounds would have 2800 ft-lbs of potential energy at a height of 8 feet. To protect such a tool from an accidental air drop of 40 feet would require 5 bellow sections.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. An impact dissipation system for a downhole toolstring, wherein the system comprises:

a housing;

a carriage located within the housing, wherein the carriage is configured to move relative to the housing upon a predetermined impact force; and a dissipator disposed inside the housing between the carriage and an end of the housing, wherein the dissipator is configured to at least partially plastically deform when the carriage moves relative to the housing, wherein the carriage is configured to contact the dissipator and cause the dissipator to compress as the carriage moves within the housing, wherein the carriage is coupled to a base by a line passing internally through the dissipator, wherein the base comprises a landing ring that is part of a landing ring sleeve telescopically received within a drop-off tool and the carriage can be coupled to the downhole toolstring by a line passing through the dissipator.

2. The system of claim 1, wherein the dissipator comprises multiple sections.

3. The system of claim 2, wherein at least one dissipator section in the toolstring may be replaced individually.

4. The system of claim 2, wherein at least one dissipator section in the toolstring is collapsible under a different force than another section in the toolstring.

5. The system of claim 1, wherein the dissipator is configured to dissipate impact force to below about 100 G.

6. The system of claim 1, wherein upon collapse, the downhole toolstring experiences an impact force to below about 100 G.

7. The system of claim 1, wherein the downhole toolstring comprises a wireline tool.

8. The system of claim 1, wherein the dissipator is configured as a bellows.

9. The system of claim 1, wherein the carriage comprises a coupler configured to release from the base when a predetermined force is exceeded.

10. The system of claim 1, wherein the downhole toolstring is conveyed into a borehole via a suspension element.

11. The system of claim 9, wherein the suspension element is a wireline cable.

12. The system of claim 1, wherein the downhole toolstring is pumped into the borehole.

13. An impact dissipation system for a downhole toolstring, wherein the system comprises:

a drop-off tool comprising a landing ring;

a housing;

a carriage located within the housing, wherein the carriage is configured to move relative to the housing upon a predetermined impact force transferred from the landing ring;

a line coupling the carriage to the drop-off tool, the line passing within and extending from the housing and into the drop-off tool to fix the carriage to the drop-off tool; and a dissipator disposed inside the housing between the carriage and an end of the housing, wherein the dissipator is configured to at least partially plastically deform when the carriage moves relative to the housing, wherein the carriage is configured to contact the dissipator and cause the dissipator to compress as the carriage moves within the housing.

14. The system of claim 13, wherein the carriage is configured to release from the drop-off tool when a predetermined force is exceeded.

15. The system of claim 13, wherein upon collapse of the dissipator, the toolstring experiences a deceleration force of less than about 100 G.

16. The system of claim 13, wherein the dissipator is configured to dissipate impact force to below about 100 G.

17. The system of claim 13, wherein the dissipator comprises a plurality of dissipator segments.

18. The system of claim 13, wherein at least one dissipator segment in the toolstring may be replaced individually.

* * * * *